United States Patent [19]

Schroeder, Jr.

[11] 3,960,454

[45] June 1, 1976

[54] APPARATUS FOR CLEANING BOWLING LANES

[76] Inventor: Kenneth K. Schroeder, Jr., Rte. 3 Box 56, Antioch, Ill. 60002

[22] Filed: June 5, 1975

[21] Appl. No.: 583,957

[52] U.S. Cl. ..... 401/140; 401/204; 15/231

[51] Int. Cl.[2] ..... A47L 13/46

[58] Field of Search ..... 401/140, 204–206, 401/138; 15/228, 231

[56] References Cited

UNITED STATES PATENTS

| | | | |
|---|---|---|---|
| 850,814 | 4/1907 | Burdett | 401/199 |
| 1,991,693 | 2/1935 | Oberti | 15/231 |
| 2,187,671 | 1/1940 | Suddarth | 401/140 X |
| 2,273,371 | 2/1942 | Oberti | 15/231 |
| 2,810,149 | 10/1957 | Guelkor | 15/231 |

*Primary Examiner*—Lawrence Charles
*Attorney, Agent, or Firm*—Michael G. Berkman

[57] ABSTRACT

A manually manipulated and propelled apparatus to bear upon and to traverse the floor surface of a bowling alley lane for cleaning and conditioning thereof. The apparatus is characterized in that it includes a reservoir for a floor-treating liquid composition, a wiper assembly including a web for applying treating composition to the floor surface, and an improved liquid flow and feed system of conduits and flow regulating means to direct and to control the rate of delivery of liquid from the reservoir to the web. The web is advanceable stepwise, as required, to present new increments of web to engage the floor surface.

2 Claims, 6 Drawing Figures

APPARATUS FOR CLEANING BOWLING LANES

The present invention relates to a floor cleaning and conditioning apparatus. More particularly, the invention is directed to a device exhibiting special utility in the cleaning and conditioning of the hard wood surfaces of bowling alley lanes.

It has long been appreciated that thorough and meticulous cleaning, conditioning, and general maintenance of the hard wood surfaces of bowling lanes are essential in bowling lane establishments if user patronage is to be sustained. While the coating compositions, cleaning materials, and conditioning agents used for this purpose vary considerably, certain procedures are basic. In all cases the alley surface must be periodically cleaned, and thereafter, a protective coating applied. Such a coating may include protective waxlike agents or other compositions which are not readily removable through the use of aqueous detergent mixtures. Moreover, application of water base cleaning compositions is objectionable in that they adversely affect the wood grain and playing surface characteristics. Accordingly, it has been a common practice to "clean" the bowling lane hard wood surface with a towel-like mop wetted with an organic solvent such as a chlorinated hydrocarbon. Cleaning solutions containing methylene chloride have found wide acceptance.

The use of mops and mop-like wipers as solvent distributing and floor scrubbing means poses certain problems. For example, it has been extremely difficult to apply and to distribute the solvent uniformly so as to obviate the formation of inordinately "wet" areas. The use of excess solvent should be avoided, not only because of the high cost of the material involved, but also because the sustained volatilization of solvent as vapors is objectionable from a health and ecological standpoint. Ideally, the quantity of cleaner should be limited to what is necessary to achieve a uniform application, as a thin film, over the entire area of the floor surface treated. It is, accordingly, the aim of the present invention to provide a machine which avoids the shortcomings of prior devices and which simply and effectively meets standards of performance recognized as desirable.

It is a principal object of the invention to provide a relatively low cost yet highly efficient and effective apparatus for applying a cleaning material or a coating composition to the hard wood surface of a bowling lane to maintain the lane in a state of functional excellence for bowling use.

A related object of the invention is to provide a bowling lane conditioning machine which is manually propelled and which bears upon the bowling lane hard wood surface to apply to that surface a cleaning or conditioning composition under adjustable and controlled feed or flow conditions.

Yet another object of the invention is to provide, in an apparatus for cleaning and conditioning bowling lanes, an improved fluid flow and feed assembly so that the material applied to the treated surface is uniformly spread and excess deposition avoided.

Yet another object of the invention is to provide a bowling lane treating machine which is physically sized and dimensioned to treat the entire width of the lane in a single lengthwise traverse.

Another object of the invention is to provide a bowling lane treating machine in which the material which applies the composition and which is in contact with the surface of the lane may, periodically, at will, be "changed" so as to bring a new, clean fabric section into contact with the floor surface.

Another feature of the apparatus of the invention is that, as structured, it ensures, inherently, that proper and even pressure will be applied to the surface being treated.

Yet another object of the invention is to provide a machine in which, at all times, the only part of the machine which bears upon and contacts the hard wood surface is that element which is intended to apply and to spread the cleaner or treating composition.

Still another object of the invention is to provide, in a simple floor cleaning, coating, and conditioning machine, a fluid feed system which ensures a uniform application of fluid across the entire lateral expanse constituting the zone of application.

A related object of the invention is to provide, a machine for applying a liquid preparation to a floor surface, the machine utilizing simple yet highly effective and readily adjustable means whereby the rate of liquid application and the quantity of fluid deposited may be simply and effectively varied as required.

It is a feature of the apparatus of the invention that the rate of fluid deposition is essentially independent of the "head" of liquid in the fluid supply tank or reservoir.

It is a general feature of the machine of the invention that it is sturdy of construction, reliable in operation, and inexpensive to construct.

Other and further objects and features of the invention will become apparant from a reading of the following specification considered in conjunction with the drawing in which.

Figure 1:
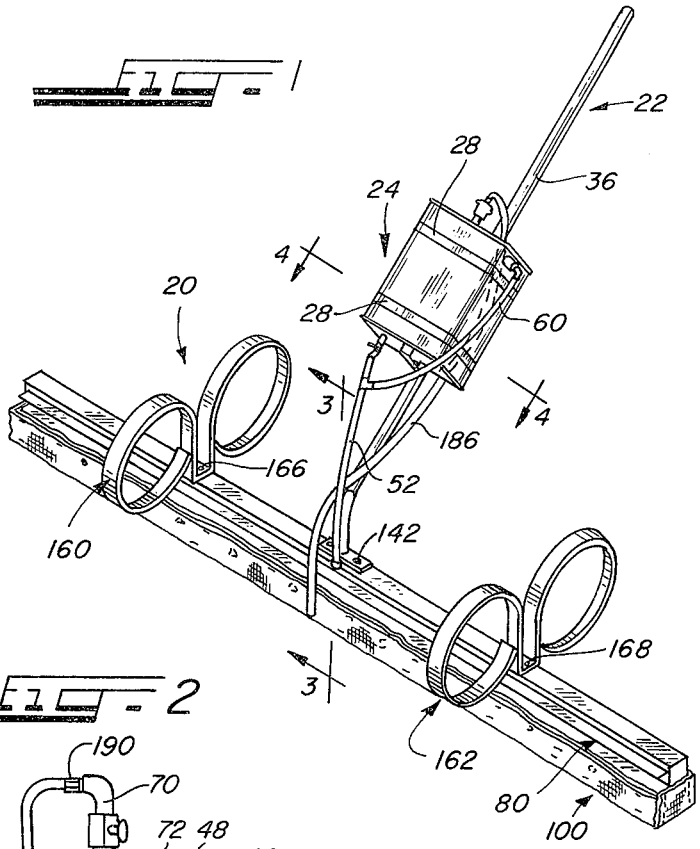
FIG. 1 is a perspective view of an apparatus, in accordance with the present invention, for cleaning bowling lanes and other floor surfaces.
Figure 6:
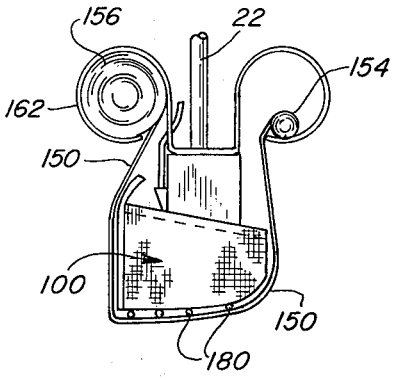
FIG. 6 is an end view indicating, schematically, the manner in which the floor-engaging toweling web of the machine is trained to extend between a feed roll and a pick-up roll.

In accordance with the subject invention, the aims and objects are accomplished by providing a manually manipulable and propelled machine which is self contained and includes, in addition to a floor surface contacting applicator assembly, a fluid reservoir, conduits for delivery of liquid from the reservoir to the applicator, and fluid flow control means and distribution means for ensuring optimum delivery rates and effective, metered distribution of the treating fluid to the floor surface.

Referring now to the drawing, and particularly to FIGS. 1–4, there is shown, for the purpose of illustrative disclosure, a preferred embodiment of one form of the floor cleaning and conditioning machine of the invention. As depicted, the apparatus 20 bears directly upon the bowling lane surface or other floor substrate which it traverses, the machine being conveniently directed and manipulated by means of a handle 22. A liquid supply tank or reservoir 24 is fastened to the handle 22 by means of straps or bands 28 and cooperating bars 30 to which the bands 28 are connected. Handle-gripping U-bolts 34 looped about the handle shaft 36 are secured to the bars 30, all as clearly shown in FIGS. 2 and 4. Preferably, as indicated, tje bands 28 are held and tightened in place by means of wing nuts 40 applied to threaded end structures 42 on the bands 28. The nuts 40 may be readily loosened for replacement of the tank.

Figure 2:
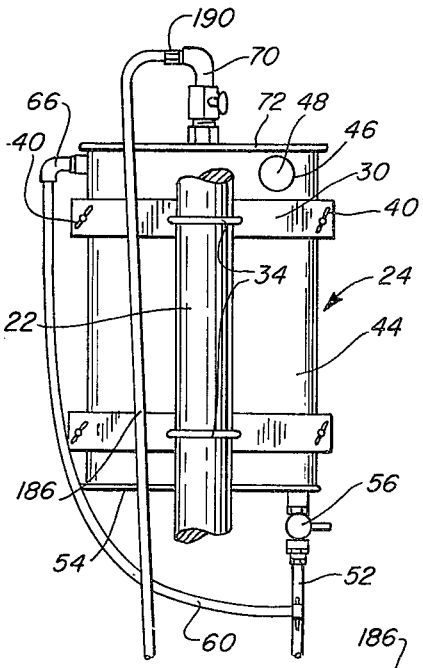
FIG. 2 is an enlarged, fragmentary view of a portion of the apparatus, illustrating specifically the fluid supply tank and the manner of its attachment to the handle of the machine.

The reservoir tank 24 is specially adapted for the purposes of the invention, pertinent features being shown in FIG. 2. On its rear side 44 the tank 24 is provided with a filling port 46 capped with a threaded cover 48. A fluid delivery line 52 is coupled to the bottom 54 of the tank 24 through a control valve 56, and a bleeder line 60 connects the liquid delivery line 52 to the upper part of the tank 24 through a suitable fitting 66.

The tank 24 is also provided with a vapor vent 70 which is preferably a needle valve connected to the top panel 72 of the tank 24. Typically, the liquid contained in the tank 24 is a solvent preparation capable of removing old wax or wax-like coating material from the alley surface. Solutions containing methylene chloride or other halogenated solvents are suitable.

Figure 3:
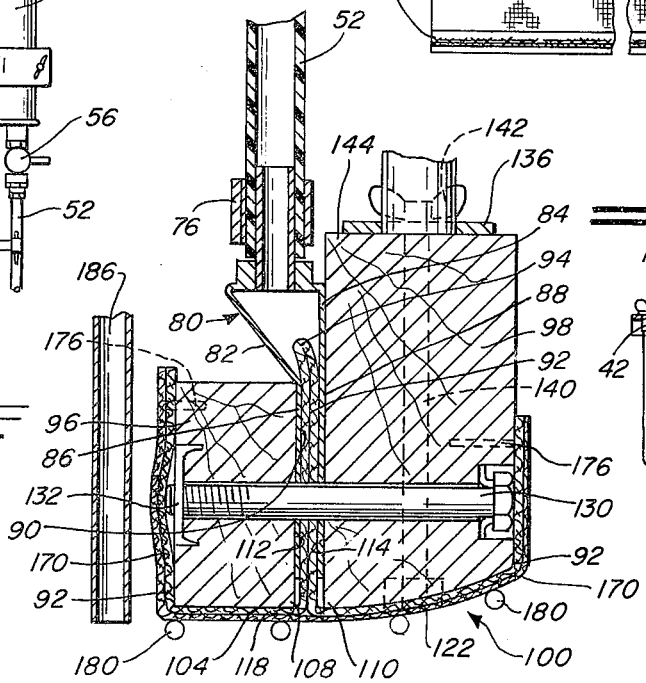
FIG. 3 is a cross sectional view taken substantially on the lines 3—3 of FIG. 1 and illustrating the manner in which the fluid is delivered to the floor-contacting elements of the apparatus.
Figure 4:
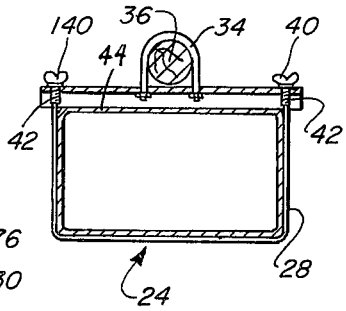
FIG. 4 is a cross sectional view taken substantially on the lines 4—4 of FIG. 1 and indicating the manner in which the fluid reservoir is secured to the handle of the machine.

The manner in which the cleaning or treating liquid preparation is delivered to and applied to the floor surface will be described with reference to FIG. 3. As shown, the fluid delivery line 52 is connected through a fitting 76 to a channel or trough 80 which extends substantially the full lateral expanse of the apparatus. In the form of the invention illustrated, the trough 80 includes a pair of walls 82 and 84 which converge in a downwardly direction to define at their coextensive, elongated ends a pair of lips 86 and 88 forming a slot or slit 90. Extending into and closely engaged within the slit 90 is a fluid feed fabric or wick 92 looped or folded upon itself so that a double thickness looped end 94 lies within the trough 80 and extends along the entire length thereof. The folded wick 92 extends downwardly as a double thickness web between a pair of rail blocks or compression blocks 96 and 98 which also extend for the full lateral width or length of the device and which together constitute a skid, rail, or float bar 100 the under surface 104 of which bears upon and traverses the substrate being treated. At the lower extremities 108, 110 of the wick-engaging sides 112 and 114 of the blocks 96 and 98 the folded wick 92 separates into two single thickness components, one 118 passing under and being trained about the forward block 96 and the other 122 passing beneath the rear block 98 and partially therearound. In the resulting structure the bottom of the compression block assembly or float bar 100 is wrapped with the fluid-carrying wick 92.

A series of spaced mechanical fasteners interconnect the blocks 96 and 98 front-to-rear along their coextensive lengths and serve as means for forcing the trough lips 86 and 88 toward one another and for applying controlled compressive force to the wick 92 confined between the lips 86 and 88 and the blocks 96 and 98. In the particular embodiment of the structure shown, the fasteners are sets of bolts 130 and nuts 132. It will be appreciated that the greater the compressive force applied to the wick 92 by the rail blocks 96 and 98 through the bolt and nut assemblies 130 and 132, the lesser will be the volume rate of fluid flow through the wick 92 from the trough 80 to the undersurface of the applicator assembly.

Any preferred technique may be used to secure the handle 22 to the applicator assembly, a flanged plate 136 and a cooperating bolt 140 and surmounting nut 142 being used in the enbodiment depicted. The flange 136 overlies the upper face 144 of the block 98 and the bolt 140 passes vertically through the block 98 and through the flange 136 to engage the nut, the bolt head being recessed or countersunk in the block 98.

In the preferred form of the machine 20 shown, the liquid carrying wick 92 does not physically contact the floor or substrate across which the machine is propelled. Such an arrangement would be objectionable as necessitating frequent replacement of the wick due to soiling and wear. In accordance with the practice of the present invention, there is provided a towel-like fabric web 150 as the floor-engaging material. The webbing 150 is conveniently carried as a rolled sheet in the form of a feed roll 154 and a pick-up roll 156, the rolls being supported on the float bar 100 by means of ring-like open loop double brackets 160 and 162 each intermediately fastened 166 and 168 to the float bar 100 as indicated in FIG. 1. It will be appreciated that the toweling web passes beneath the float bar 100 and may be shifted, periodically as required, by rolling scroll-wise to present a new or clean increment as a contact zone to bear on the floor surface treated.

Figure 5:
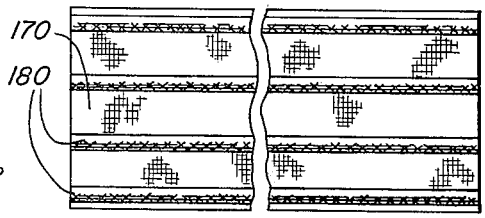
FIG. 5 is a bottom plan view of the machine of FIG. 1, showing the undersurface of the machine before the covering layer of floor-contacting toweling material is applied.

Since the inertia of the rolled toweling or floor-engaging web 150 may be inadequate to oppose the frictional forces impressed during movement of the apparatus along the floor, in the preferred embodiment of the apparatus shown there is provided, as an intermediate coupling member between the wick 92 and the toweling 150, a friction sheet 170. The friction sheet 170 and the marginal portions of the wick 92 are fastened to the float bar blocks 96 and 98 by means of staples 176. Further to minimize slippage and to enhance positive wiping contact of the web 150 with the floor surface being treated, a series of longitudinally extending, spaced ribs or cord-like friction bars 180 are fastened on the undersurface of the friction sheet 170 to extend longitudinally across the full expanse thereof, as indicated in FIG. 3 and in FIG. 5.

It is believed that the manner in which the cleaning apparatus of the invention is used will be evident upon consideration of the foregoing descriptive material. Attention is directed, however, to certain less-obvious advantageous features of the structure descrived. For example, in filling the liquid supply tank 24 it is necessary merely to pivot the apparatus counterclockwise as viewed in FIG. 1 so that the handle 22 assumes a position substantially parallel to the floor and the filling port 46 is conveniently and readily accessible. In the attitude described, the apparatus rests on a pair of rings of the roll towel holders 160 and 162 so that the liquid application web 150 is supported and is out of contact with the floor, eliminating contact seepage.

The liquid feed assembly includes as independent but augmenting flow rate controls the valve 56 in the fluid delivery line 52 and the needle valve vent or bleeder 70 at the top of the supply tank 24. In order to obviate a need to close the bleeder valve 70 during tank filling and to avoid valve setting readjustment, there is provided a pipe or tube 186 which extends from the air inlet end 190 of the bleeder valve 70 to a position adjacent the toweling web 150 at the applicator assembly. Accordingly, any small quantity of fluid which may escape from the supply tank 24 and through the bleeder valve 70 during the filling operation will be delivered directly to the applicator assembly, and spillage avoided.

The materials of construction of the apparatus of the invention are selected for optimum functional characteristics including lightness of weight and durability. Wood stock has been found to be completely suitable for the block elements 96 and 98 of the float bar 100. The assembly itself is preferably of such a length (lateral width) as to cover the entire lateral expanse of the bowling alley lane in a single pass.

Although a preferred embodiment of the invention has been illustrated and described, and while preferred structural materials have been suggested, variations coming within the true spirit and scope of the invention are to be determined by the appended claims.

What is claimed is:

1. In apparatus for cleaning and treating bowling alley lanes and similar floor surfaces, said apparatus including, in combination, handle means for propelling and manipulating said apparatus along a work surface to be treated, a reservoir adapted to contain a supply of liquid for application to the surface to be treated, applicator means including means adapted for sliding frictional engagement with a work surface to be treated to apply treating liquid thereto across a substantial lateral expanse thereof, securement means interattaching said handle means, said reservoir, and said applicator means to provide a composite functional assembly, and fluid conducting means communicating between said reservoir and said applicator means for delivery of treating liquid from said reservoir to said applicator means, and fluid flow control means for regulating the rate of fluid delivery from said reservoir to said applicator means, the improvement wherein said fluid flow control means comprises selectively adjustable air bleeder vent means in communication with said reservoir for limiting and regulating air admission into said reservoir thereby to facilitate controlled discharge of fluid therefrom, said air bleeder vent means including a valve connected to said reservoir for providing a manually regulable air passage between ambient atmosphere and said reservoir at an interior zone thereof above a level of liquid contained in said reservoir.

2. The improvement as set forth in claim 1 wherein said applicator means includes a float bar extending across said apparatus transversely of a direction of movement of said apparatus during use, fabric means covering said float bar and constituting a wiper web for riding on a work surface as said apparatus traverses the surface, and a friction sheet interposed between said float bar and said web, for holding said wiper web fixed in place during use of said apparatus, and fastening means for securing said friction sheet firmly fixed in place relative to said float bar.

* * * * *